US005898788A

United States Patent [19]

Kim

[11] Patent Number: 5,898,788

[45] Date of Patent: Apr. 27, 1999

[54] LOUDSPEAKER SYSTEM

[75] Inventor: Jae-Nam Kim, Suwon, Rep. of Korea

[73] Assignee: Samsung Electronics Co., Ltd., Suwon, Rep. of Korea

[21] Appl. No.: 08/781,534

[22] Filed: Jan. 8, 1997

[30] Foreign Application Priority Data

Apr. 22, 1996 [KR] Rep. of Korea ..... 96-12223

[51] Int. Cl.[6] ..... H04R 25/00

[52] U.S. Cl. ..... 381/341; 381/340; 381/342; 181/152

[58] Field of Search ..... 381/153, 154, 381/156, 159, 182, 186, 188, 205, 88, 89, 90, 337, 339, 340, 341, 349, 332; 181/144, 145, 152, 155, 156, 175, 177, 187

[56] References Cited

U.S. PATENT DOCUMENTS 4,969,196 11/1990 Nakamura ..... 381/156
5,025,886 6/1991 Jung ..... 381/156
5,206,465 4/1993 Jung ..... 181/156
5,604,337 2/1997 Sugimoto et al. ..... 381/156

FOREIGN PATENT DOCUMENTS 406038284 2/1994 Japan ..... 381/159

*Primary Examiner*—Huyen Le
*Attorney, Agent, or Firm*—Staas & Halsey

[57] ABSTRACT

A loudspeaker system capable of minimizing interference of sound waves and increasing bass sound amplification efficiency by collecting and amplifying only a portion of the sound waves radiated from the rear of a loudspeaker. The loudspeaker system includes a supporting member having a partition formed therein, an amplifying horn for collecting and amplifying only a portion of the sound waves radiated from the rear of a loudspeaker, a discharge horn for discharging the amplified sound waves, and a guide plate for guiding the sound waves discharged from the loudspeaker and through the discharge horn.

20 Claims, 4 Drawing Sheets

LOUDSPEAKER SYSTEM

BACKGROUND OF THE INVENTION

1. Field of the Invention

The present invention relates to a loudspeaker system for audio appliances, television receivers, etc., and more particularly, to a loudspeaker system which can improve the bass sound characteristics and increase the straight-traveling property of radiated sound waves by amplifying the sound waves discharged from the rear of a loudspeaker.

2. Description of the Related Art

Generally, a loudspeaker converts an electric signal into a sound wave signal and radiates the sound wave signal into free space. A cone type loudspeaker is the most frequently used conventional loudspeaker. In a cone type loudspeaker, if a strong cylindrical magnetic field is created in a magnet which is located between a center pole and a yoke, as current is applied to a voice coil which is disposed in the magnetic field, force is induced to vibrate a conical vibrating board, made of paper, for example, to thereby radiate sound waves.

Since the force is constant regardless of a frequency, it is possible to obtain flat frequency characteristics over a wide range of frequencies. The low frequency zone of the loudspeaker system is restricted by a minimum resonance frequency determined by an equivalent mass including a radiation mass and a compliance due to edge, damper, etc. The high frequency zone is restricted by divided vibration due to a limit in the rigidity of a cone paper.

In divided vibration, since a small diameter of the cone paper yields a higher frequency, loudspeakers having the same structures and different cone diameters are used in combination to radiate sound waves having a wider range of frequencies.

In addition to the minimum resonance frequency, the low frequency zone radiation is influenced by the size of a cabinet containing the loudspeaker. This is because when the cone is vibrated to radiate the sound waves, counter phases are generated in the forward and rearward directions from the cone, and may interfere with each other, so that the sound waves are not properly radiated in the low frequency zone.

Accordingly, to obtain the sound waves of a low frequency, the size of the cabinet must be somewhat large. This prevents an audio appliance, television receiver, etc., from being compact.

A conventional loudspeaker system for amplifying sound waves radiated from the rear of a loudspeaker, as shown in FIG. 1, includes a loudspeaker 2, disposed inside a loudspeaker cabinet 1, for radiating the sound waves, a wave guide 3 for transmitting the sound waves radiated from the rear of the loudspeaker 2, and a horn 4 for amplifying the transmitted sound waves.

The sound waves generated from the loudspeaker 2 are radiated from the front of the loudspeaker 2 and simultaneously from the rear of the loudspeaker 2. The sound waves radiated from the rear of the loudspeaker 2 are transmitted for a predetermined distance through the wave guide 3, and then are radiated to the front portion of the cabinet 1 through the horn 4.

However, the conventional loudspeaker system as constructed above suffers from drawbacks in that although a portion of the bass sound waves radiated from the rear of the loudspeaker can be amplified to some extent, since the sound waves radiated from the rear of the loudspeaker are totally transmitted through the wave guide 3 and the horn 4, serious interference occurs between the sound waves radiated from the rear of the loudspeaker that have a frequency lower than a desired level. Particularly, bass of a very low level can not be properly amplified and the clarity of the resulting sound deteriorates severely due to the distortion of the sound waves.

Also, the straight-traveling property of the sound waves radiated through the loudspeaker 2 and the horn 4 deteriorates due to interference generated therebetween, and thus the sound waves cannot be transferred over a long distance.

SUMMARY OF THE INVENTION

It is an object of the present invention to solve the problems involved in the related art, and to provide a loudspeaker system which increases the bass sound amplification efficiency and ensures clarity of the resulting sound by collecting and amplifying only a portion of the sound waves radiated from the rear of a loudspeaker.

It is another object of the present invention to provide a loudspeaker system which increases the transmitting distance of the sound waves by improving the straight-traveling property of the sound waves radiated through the loudspeaker and the horn.

To achieve the above and other objects and advantages, there is provided a loudspeaker system comprising a supporting member having a partition formed therein; a loudspeaker, mounted on the supporting member, for radiating sound waves in forward and rearward directions therefrom; an amplifying horn for collecting and amplifying only a portion of the sound waves radiated from a rear of the loudspeaker; a discharge horn for discharging the sound waves amplified by the amplifying horn; and a sound wave guide plate for guiding the sound waves discharged from the loudspeaker and through the discharge horn so as to increase a straight-traveling property of the discharged sound waves.

BRIEF DESCRIPTION OF THE DRAWINGS

The above objects, other features, and advantages of the present invention will become more apparent by describing the preferred embodiment thereof with reference to the accompanying drawings, in which.

DETAILED DESCRIPTION OF PREFERRED EMBODIMENTS

Figure 1:
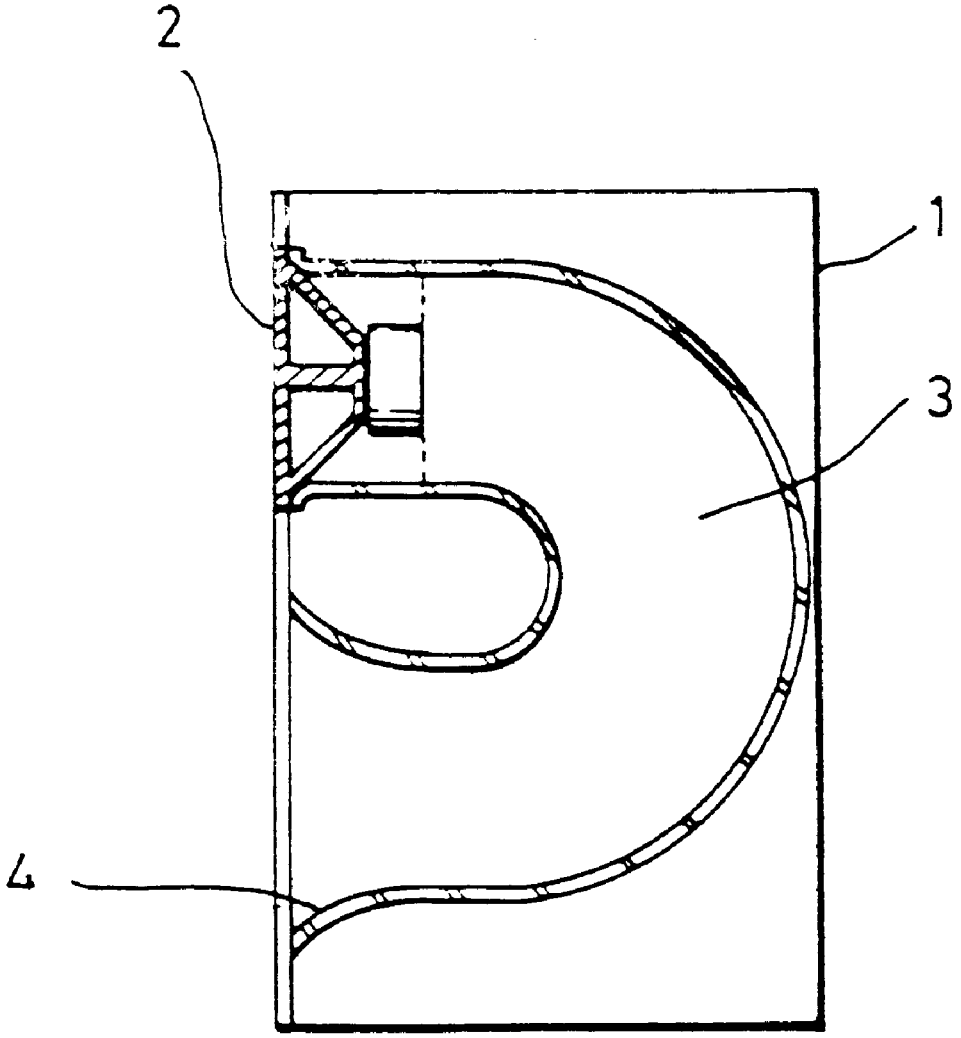
FIG. 1 (Prior Art)
FIG. 1 is a sectional view of a conventional loudspeaker system.
Figure 2:
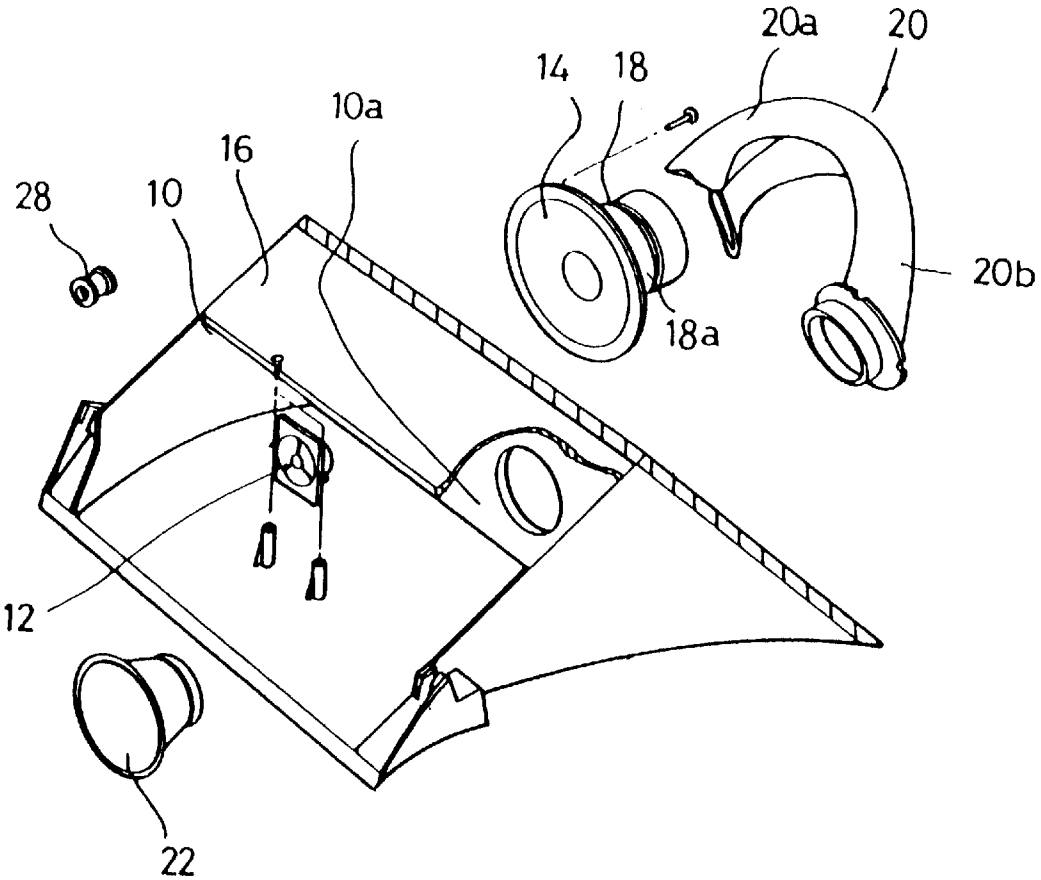
FIG. 2 is an exploded perspective view of the loudspeaker system according to an embodiment of the present invention.
Figure 3:
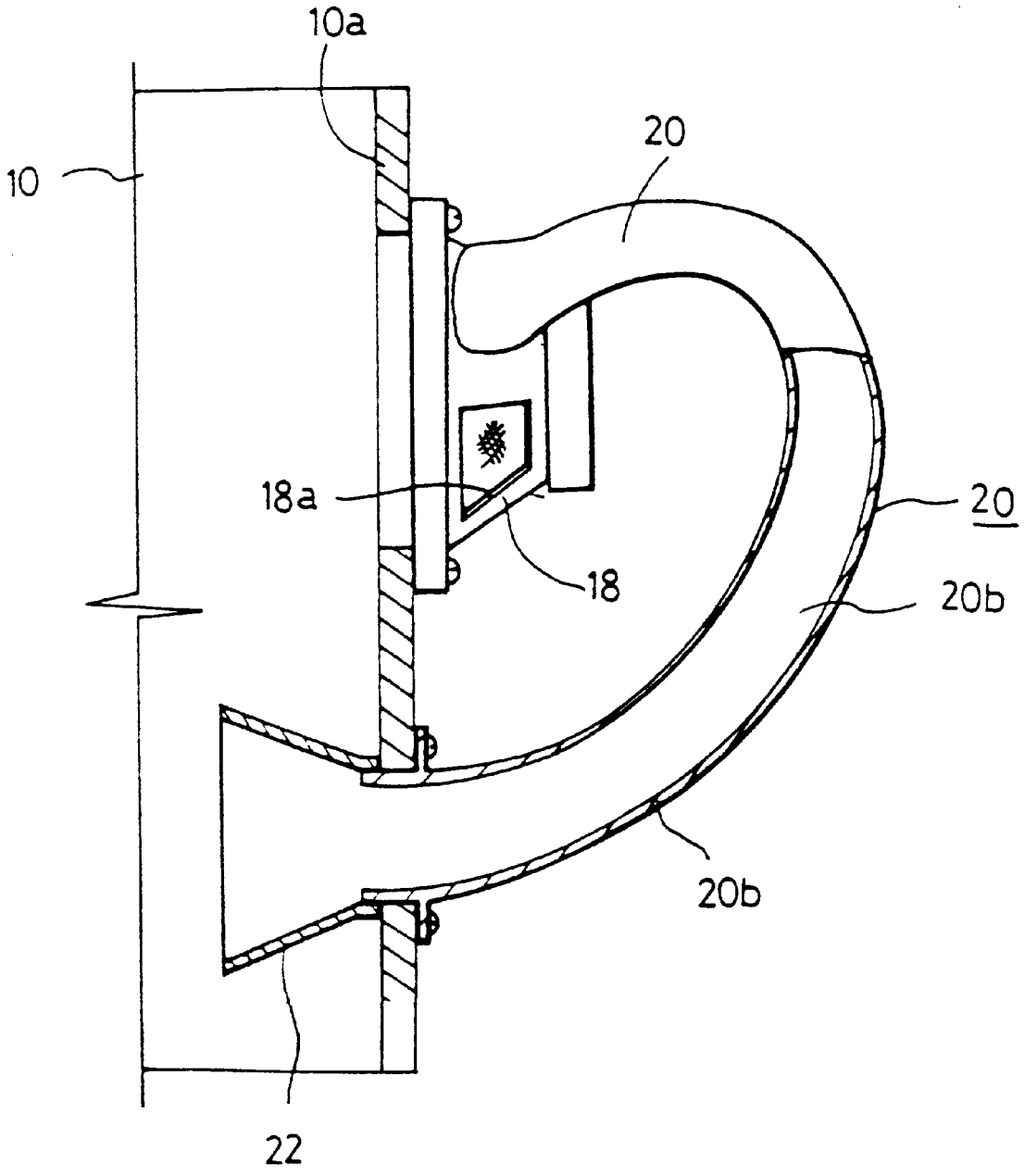
FIG. 3 is a sectional view of the loudspeaker system of FIG. 2 in an assembled state.
Figure 4:
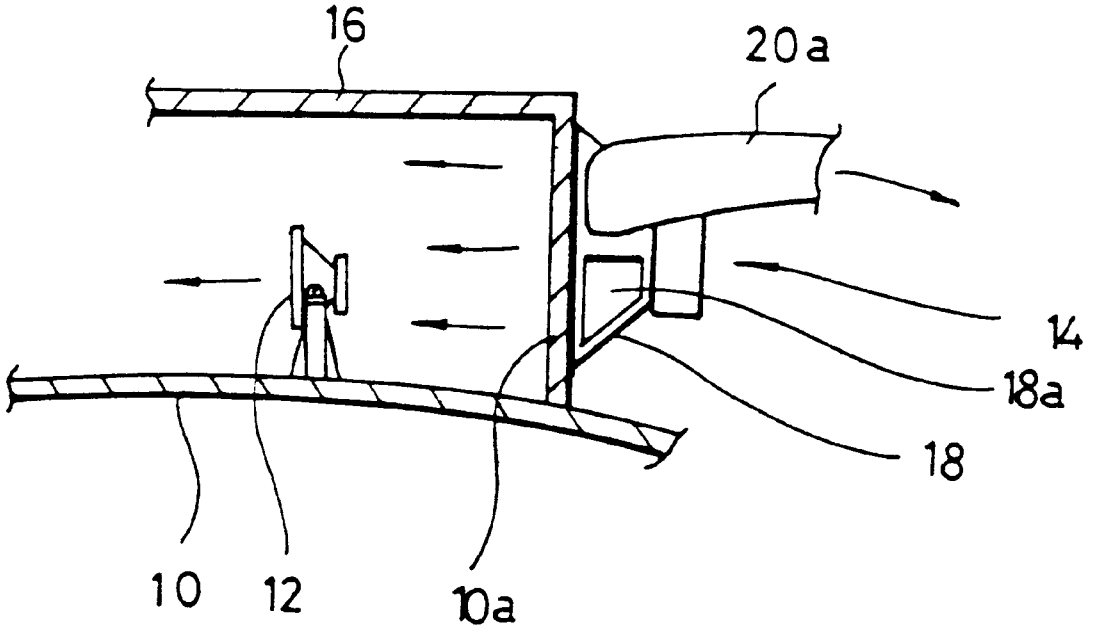
FIG. 4 is a sectional view of a part of the loudspeaker system according to the embodiment of the present invention.

FIG. 2 is an exploded perspective view of a loudspeaker system according to an embodiment of the present invention, and FIG. 3 is a sectional view of the loudspeaker system of FIG. 2 in an assembled state. FIG. 4 is a sectional view of a part of the loudspeaker system according to the embodiment of the present invention.

Referring to FIGS. 2 to 4, a tweeter 12 is securely fastened to the front surface of a supporting member 10 installed on both sides of a cabinet of an audio appliance, television receiver, etc. A loudspeaker 14 for intermediate and bass sounds is secured to a partition 10*a* formed on the rear portion of the supporting member 10, and a sound wave guide plate 16 is extendedly formed on one side of the partition 10*a*.

On the rear portion of the loudspeaker 14 is secured an amplifying horn 20 including a plurality of collecting parts 20*a* disposed in openings 18*a* of a frame 18 of the loudspeaker 14, and an amplifying part 20*b* for amplifying the sound waves collected by the collecting parts 20*a*.

In the amplifying horn 20, the sound waves radiated from the rear of the loudspeaker 14 are collected by the collecting parts 20*a*, and the collected sound waves are amplified through the amplifying part 20*b*, so that the bass sounds radiated from the rear of the loudspeaker 14 are effectively amplified to obtain harmonized sounds.

It is preferable that the sum of diameters of the collecting parts 20*a* in the amplifying horn 20 is determined to be equal to the minimum diameter of the amplifying part 20*b* to prevent the interference from being generated between the collected sound waves. It is also preferable that the diameter of the amplifying part 20*b* is gradually increased toward the end portion thereof to achieve the amplification of the sound waves.

Meanwhile, a discharge horn 22 for discharging the amplified sound waves is connected to the end of the amplifying horn 20.

The supporting member 10 is provided with an anti-vibration packing 28 secured thereto to prevent vibrations generated due to the sound waves radiated from the loudspeaker 14 from being transferred to the cabinet when the supporting member 10 is fixedly installed on both sides of the cabinet.

The operation of the loudspeaker system as constructed above will now be explained.

If a cone of the loudspeaker 14 vibrates and generates sound waves by a strong cylindrical magnetic field created in a magnet, the generated sound waves are radiated through a front portion of the audio appliance, television receiver, etc., through the loudspeaker 14 and the tweeter 12, to produce sound waves of high and intermediate tones.

At this time, a portion of the sound waves radiated from the rear of the loudspeaker 14 is collected and amplified through the amplifying horn 20, and then is discharged through the front portion of the supporting member 10.

Specifically, a portion of the sound waves radiated through the openings 18*a* of the frame formed on the rear portion of the loudspeaker 14 is collected by the collecting parts 20*a* formed on the front end of the amplifying horn 20, amplified by the amplifying part 20*b*, and then is discharged through the discharging horn 22. Accordingly, the bass sound can be effectively amplified to produce the harmonized sounds.

At this time, the sound waves radiated through the loudspeaker 14, discharge horn 22, and tweeter 12 have a good straight-traveling property, by passing through the guide plate 16 formed on one side of the supporting member 10, and thus the interference generated between the radiated sound waves is minimized. Accordingly, clear and harmonized sound waves can be obtained, as well as the result that sound waves can be transmitted over a longer distance.

The anti-vibration packing 28, which is fixedly installed between the supporting member 10 and the cabinet, minimizes the vibration of the supporting member 10 caused by the radiated sound waves during the operation of the loudspeaker 14.

From the foregoing, it will be apparent that the loudspeaker system according to the present invention provides the advantages in that it minimizes the interference generated between the sound waves through the amplifying horn, increases the bass sound amplification efficiency, and ensures clarity and harmonization of the resulting sounds by collecting and amplifying only a portion of the sound waves radiated from the rear of the loudspeaker. Further, since the sound waves radiated through the loudspeaker, tweeter, and discharge horn have a straight-traveling property by means of the sound wave guide plate, the sound waves can be transmitted over a longer distance.

While the present invention has been described and illustrated herein with reference to the preferred embodiment thereof, it will be understood by those skilled in the art that various changes in form and details may be made therein without departing from the spirit and scope of the invention.

What is claimed is:

1. A loudspeaker system comprising:

a supporting member having a partition formed therein;

a loudspeaker, mounted on said supporting member, for radiating sound waves in forward and rearward directions therefrom;

an amplifying horn for collecting and amplifying only a portion of said sound waves radiated from a rear of said loudspeaker;

a discharge horn for discharging said sound waves amplified by said amplifying horn; and a sound wave guide plate for guiding said sound waves discharged in said forward direction from said loudspeaker and in said rearward direction through said discharge horn so as to increase a straight-traveling property of said discharged sound waves.

2. A loudspeaker system as claimed in claim 1, wherein:

said loudspeaker has a frame with openings; and said amplifying horn comprises a plurality of collecting parts for collecting said sound waves radiating through the openings of the frame of said loudspeaker, and an amplifying part, extending from said collecting parts, for amplifying said collected sound waves.

3. A loudspeaker system as claimed in claim 2, wherein said amplifying part has a minimum diameter at least as great as a sum of diameters of all of said plurality of collecting parts.

4. A loudspeaker system as claimed in claim 2, wherein said amplifying part has a first end connected to said plurality of collecting parts and a second end connected to said discharge horn, wherein a diameter of said amplifying part increases from the first end toward the second end.

5. A loudspeaker system as claimed in claim 4, wherein said amplifying part has a minimum diameter at least as great as a sum of diameters of all of said plurality of collecting parts.

6. A loudspeaker system as claimed in claim 2, further comprising:

a cabinet for holding said supporting member, loudspeaker, amplifying horn, discharge horn and sound wave guide plate; and packing fixedly installed between said supporting member and said cabinet, to minimize a vibration of said supporting member caused by the radiated sound waves.

7. A loudspeaker system as claimed in claim 1, wherein said sound wave guide plate is extendedly formed on a front end of said partition.

8. A loudspeaker system as claimed in claim 1, further comprising:

a cabinet for holding said supporting member, loudspeaker, amplifying horn, discharge horn and sound wave guide plate; and packing fixedly installed between said supporting member and said cabinet, to minimize a vibration of said supporting member caused by the radiated sound waves.

9. A loudspeaker system, comprising:

a supporting member having a partition with an opening formed therein;

a loudspeaker, mounted on said supporting member, to radiate sound waves in a first direction through the opening of said partition and in a second direction opposite said first direction;

an amplifying horn to collect and amplify only a portion of said sound waves radiated in the second direction; and a discharge horn to discharge said sound waves amplified by said amplifying horn in substantially said first direction.

10. A loudspeaker system as claimed in claim 9, further comprising a sound wave guide plate to guide the sound waves discharged from said loudspeaker in the first direction and through said discharge horn to increase a straight traveling property of said discharged sound waves.

11. A loudspeaker system as claimed in claim 9, further comprising a sound wave guide plate formed on one side of said partition, wherein said loudspeaker is formed on the other side of said partition, and said sound wave guide plate passes the sound waves radiated from said loudspeaker in the first direction and through said discharge horn, to provide a straight traveling property of the sound waves.

12. A loudspeaker system as claimed in claim 9, wherein said discharge horn extends from a first side of said partition opposite a second side to which said loudspeaker is mounted, and said amplifying horn is substantially semicircular in shape, to direct the sound waves radiated in the second direction in the first direction through said discharge horn.

13. A loudspeaker system as claimed in claim 9, wherein:

said loudspeaker has a frame with openings; and said amplifying horn comprises a plurality of collecting parts to collect the portion of said sound waves radiated in the second direction through the openings of the frame of said loudspeaker, and an amplifying part, extending from said collecting parts, to amplify the portion of the sound waves collected by said plurality of collecting parts.

14. A loudspeaker system as claimed in claim 13, wherein said amplifying part has a minimum diameter at least as great as a sum of diameters of all of said plurality of collecting parts.

15. A loudspeaker system as claimed in claim 13, wherein said amplifying part has a first end connected to said plurality of collecting parts and a second end connected to said discharge horn, wherein a diameter of said amplifying part continuously increases from the first end toward the second end.

16. A loudspeaker system, comprising:

a supporting member having a partition with an opening formed therein;

a loudspeaker, mounted on said supporting member, to radiate sound waves in a first direction through the opening of said partition and in a second direction opposite said first direction;

an amplifying horn to collect and amplify only a portion of said sound waves radiated in the second direction;

a discharge horn to discharge said sound waves amplified by said amplifying horn in substantially said first direction; and a tweeter mounted on said supporting member on an opposite side of said partition from said loudspeaker, to receive the sound waves radiated in the first direction from said loudspeaker, and in response, produce higher frequency sound waves than those of said loudspeaker.

17. A loudspeaker system as claimed in claim 16, further comprising a sound wave guide plate formed on one side of said partition, wherein said loudspeaker is formed on the other side of said partition, and said sound wave guide plate passes the sound waves radiated through said loudspeaker, tweeter and discharge horn, to provide a straight traveling property of the sound waves.

18. A loudspeaker system, comprising:

a supporting member having a partition with an opening formed therein;

a loudspeaker, mounted on said supporting member, to radiate sound waves in a first direction through the opening of said partition and in a second direction opposite said first direction;

an amplifying horn to collect and amplify only a portion of said sound waves radiated in the second direction;

a discharge horn to discharge said sound waves amplified by said amplifying horn in substantially said first direction;

a tweeter mounted on said supporting member on a first side of said partition opposite a second side at which said loudspeaker is mounted, to receive the sound waves radiated in the first direction from said loudspeaker, and in response, produce higher frequency sound waves than those of said loudspeaker; and a sound wave guide plate formed on the first side of said partition, and said sound wave guide plate passes the sound waves radiated through said loudspeaker, tweeter and discharge horn, to provide a straight traveling property of the sound waves;

wherein said discharge horn extends from the first side of said partition, and said amplifying horn is semicircular in shape, to direct the sound waves radiated in the second direction in the first direction through said discharge horn.

19. A loudspeaker system as claimed in claim 18, wherein:

said loudspeaker has a frame with openings; and said amplifying horn comprises a plurality of collecting parts to collect the portion of said sound waves radiated in the second direction through the openings of the frame of said loudspeaker, and an amplifying part, extending from said collecting parts, to amplify the portion of the sound waves collected by said plurality of collecting parts.

20. A loudspeaker system as claimed in claim 19, wherein said amplifying part has a first end connected to said plurality of collecting parts and a second end connected to said discharge horn, wherein a diameter of said amplifying part continuously increases from the first end toward the second end.

* * * * *